US010859049B2

(12) United States Patent
Erdemir et al.

(10) Patent No.: US 10,859,049 B2
(45) Date of Patent: Dec. 8, 2020

(54) FUEL PUMP

(71) Applicant: DELPHI TECHNOLOGIES IP LIMITED, St. Michael (BB)

(72) Inventors: Engin Erdemir, Izmir (TR); Benjamin P. West, Whitstable (GB); Gunay Cicek, Izmir (TR); Erol Kahraman, Izmir (TR)

(73) Assignee: DELPHI TECHNOLOGIES IP LIMITED

( * ) Notice: Subject to any disclaimer, the term of this patent is extended or adjusted under 35 U.S.C. 154(b) by 0 days.

(21) Appl. No.: 16/092,143

(22) PCT Filed: Mar. 28, 2017

(86) PCT No.: PCT/EP2017/057323
§ 371 (c)(1),
(2) Date: Oct. 8, 2018

(87) PCT Pub. No.: WO2017/174402
PCT Pub. Date: Oct. 12, 2017

(65) Prior Publication Data

US 2019/0093615 A1 Mar. 28, 2019

(30) Foreign Application Priority Data

Apr. 8, 2016 (GB) ..... 1605990.9

(51) Int. Cl.
*F02M 59/44* (2006.01)
*F02M 59/02* (2006.01)
(Continued)

(52) U.S. Cl.
CPC ..... *F02M 59/022* (2013.01); *F02M 59/025* (2013.01); *F02M 59/34* (2013.01);
(Continued)

(58) Field of Classification Search
CPC .. F02M 51/04; F02M 59/367; F02M 63/0265; F02M 43/02; F02M 2700/1358; F02M 2700/1364; F02M 63/0235
See application file for complete search history.

(56) References Cited

U.S. PATENT DOCUMENTS 2,101,221 A 12/1937 Orange
6,035,828 A 3/2000 Anderson et al.
(Continued)

FOREIGN PATENT DOCUMENTS

DE 511918 C 11/1930
EP 2492506 A1 8/2012
(Continued)

*Primary Examiner* — Long T Tran
(74) *Attorney, Agent, or Firm* — Joshua M. Haines

(57) ABSTRACT

A fuel pump includes a pump head defining a barrel in which a plunger is slidable to pressurise fuel in a pumping chamber, and a fluid-inlet path through which fuel flows in to the pumping chamber under control of an inlet valve during a plunger return stroke. The plunger causes pressurisation of the fuel in the fluid-inlet path. The fuel pump may also include a fluid-outlet path through which fuel flows out of the pumping chamber, preferably under control of an outlet valve, during a plunger pumping stroke.

11 Claims, 3 Drawing Sheets

(51) Int. Cl.
*F02M 59/36* (2006.01)
*F02M 59/34* (2006.01)

(52) U.S. Cl.
CPC ..... *F02M 59/36* (2013.01); *F02M 59/361* (2013.01); *F02M 59/44* (2013.01); *F02M 2700/1358* (2013.01); *F02M 2700/1364* (2013.01)

(56) References Cited

U.S. PATENT DOCUMENTS

| | | | | |
|---|---|---|---|---|
| 6,216,670 | B1 | 4/2001 | Anderson et al. | |
| 6,446,613 | B1 * | 9/2002 | Djordjevic ..... | F02M 63/005 123/456 |
| 2003/0155444 | A1 * | 8/2003 | Lawes ..... | F02D 41/40 239/585.1 |
| 2009/0159053 | A1 | 6/2009 | Stockner et al. | |
| 2013/0022458 | A1 * | 1/2013 | Joistgen ..... | F01C 21/02 415/215.1 |
| 2014/0305410 | A1 * | 10/2014 | Lucas ..... | F02M 41/00 123/456 |

FOREIGN PATENT DOCUMENTS

| | | | |
|---|---|---|---|
| EP | 2492506 | B1 | 4/2019 |
| GB | 486378 | A | 6/1938 |
| JP | 61108833 | A | 5/1986 |

* cited by examiner

FUEL PUMP

CROSS REFERENCE TO RELATED APPLICATIONS

This application is a national stage application under 35 USC 371 of PCT Application No. PCT/EP2017/057323 having an international filing date of Mar. 28, 2017, which is designated in the United States and which claimed the benefit of GB Patent Application No. 1605990.9 filed on Apr. 8, 2016, the entire disclosures of each are hereby incorporated by reference in their entirety.

TECHNICAL FIELD

The present invention relates to a fuel pump for a fuel system of an internal combustion engine and, in particular, to a fuel system including an accumulator volume in the form of a common rail for supplying fuel to a plurality of injectors.

BACKGROUND TO THE INVENTION

Conventional common rail fuel injection systems for diesel engines include a high pressure pump for charging an accumulator volume, or common rail, with high pressure fuel with which to supply a plurality of injectors of the fuel system. The pressure of fuel may be up to or even exceed 2000 bar. Typically, each injector is provided with an electronically controlled nozzle control valve to control movement of a fuel injector valve needle and, thus, to control the timing of delivery of fuel from the injectors to associated combustion chambers of the engine.

FIGS. 1*a* to 1*c* illustrate a known fuel pump 10 at various stages of a pumping cycle. The fuel pump 10 includes a fuel pump housing 12, or pumping head, provided with a plunger bore, or barrel 14, within which a pumping plunger 16 reciprocates, in use, under the influence of a drive arrangement 18. The plunger 16 and its barrel 14 extend co-axially through the pump housing 12. An upper region of the barrel 14 defines a cylindrical pumping chamber 22 of the fuel pump 10. Fuel is admitted into and is discharged from the pumping chamber 22 by an inlet passage 20 and an outlet passage 21, respectively. A fuel gallery 24 is provided in the pump housing 12 for holding low pressure fuel.

During operation of the fuel pump 10, a supply line 28 delivers low pressure fuel from a suitable source to the fuel gallery 24. The flow of low pressure fuel from the gallery 24 to the pumping chamber 22 is controlled by an inlet valve 26 that is provided in the inlet passage 20. A spring-biased inlet valve member 30 of the inlet valve 26 is configured to be movable within the inlet passage 20 in order to control the rate of flow of fuel from the gallery 24 to the pumping chamber 22. The inlet valve member 30 is displaced to an open or closed position in response to a change in the pressure differential between the gallery 24 and the pump chamber 22.

The drive arrangement 18 includes a tappet 32, which may be driven by means of a cam (not shown) to impart drive to a lower end of the plunger 16. The cam is typically connected to a cam shaft which is driven by the engine as would be well known by the skilled person. The tappet 32 is connected to a lower part of the pump housing 12 by a return spring 34. The return spring 34 is configured to impart a downward motion on the plunger 16 by recoiling once the force of the driving cam is removed. In so doing, the tappet 32 is pushed away from the pump head 12, thereby driving the plunger 16 outwardly from the plunger barrel 14.

The pump cycle of the fuel pump consists of a pumping stroke in which the plunger 16 is driven inwardly within the plunger barrel 14 to reduce the volume of the pumping chamber 22 and a return stroke in which the plunger 16 is driven outwardly from the plunger barrel 14 to increase the volume of the pumping chamber 22.

FIG. 1*a* illustrates the fuel pump after the pumping stroke has been performed, and in which the plunger 16 is in its most inward position with respect to the plunger barrel 14, thereby minimising the volume of the pumping chamber 22.

With reference to FIG. 1*b*, the return stroke starts when the plunger 16 is pulled outwardly from within the plunger barrel 14 by the return spring 34. The downward motion of the plunger 16 causes a drop in fuel pressure within the pumping chamber 22, which results in the formation of a negative pressure differential across the inlet valve 26, thereby causing it to admit low pressure fuel from the fluid-inlet gallery 24 into the high-pressure pumping chamber 22.

The pumping stroke, as shown in FIG. 1*c*, starts when the plunger 16 is at its most outward position with respect to the plunger barrel 14. During the pumping stroke, the plunger 16 is driven inwardly within the plunger barrel 14 by the drive arrangement 18. As the plunger 16 moves inwardly within the plunger barrel 14, fuel is pressurised within the pumping chamber 22 and a positive pressure differential forms across the inlet valve 26, causing the valve to close. The fuel pressure in the pump chamber 22 continues to increase as the plunger 16 moves further inside the plunger barrel 14 until, at a predetermined level, a positive pressure differential is formed across an outlet valve 36 causing it to open.

The pressurised fuel is then delivered through the outlet valve 36 to a downstream common rail of the fuel injection system. In this way the fuel pump 10 allows pressurised fuel to be delivered to the common rail of the fuel injection system for each revolution of the engine.

In common rail fuel injection systems, the trend is towards increasing the injection pressure in order to optimise the combustion quality and efficiency of the engine. In addition to improving combustion characteristics, higher injection pressures have enabled greater engine speeds to be reached which, in turn, has lead to an increase engine power outputs. However, as fuel pumps are typically driven by the engine, the increase in engine speed increases the speed envelope of the fuel pump. The increasing pump frequency leads to a reduction in the time that is available to fill the pumping chamber 22 before the pumping stroke of each pumping cycle, which can result in a reduction in the pumping efficiency of the fuel pump 10 when operating at higher engine speeds. This effect can be made worse with the trend of synchronising pump delivery with fuel injection.

This problem can be addressed somewhat by increasing the pressure fuel supplied to the fuel pump 10. However, this requires the diversion of more energy from the engine, which compromises engine efficiency and results in a subsequent increase in the carbon emissions of the vehicle, which is not desirable.

It is one aim of the present invention to provide a fuel system for a common rail fuel system which provides improvements over known common rail fuel systems and which addresses, in particular, the issue of variable injection characteristics and of parasitic fuel losses so as to provide enhanced system efficiency.

SUMMARY OF THE INVENTION

According to a first aspect of the present invention, there is provided a fuel pump comprising;

a pump head defining a barrel in which a pumping plunger is slidable to pressurise fuel in a pumping chamber, and a fluid-inlet path through which fuel flows into the pumping chamber under control of an inlet valve during a plunger return stroke, wherein the pumping plunger is configured to cause pressurisation of the fuel in the fluid-inlet path.

In one embodiment, the fuel pump comprises a fluid-outlet path through which fuel flows out of the pumping chamber, preferably under control of an outlet valve during a plunger pumping stroke.

By causing pressurisation of the fuel in the fluid-inlet path, the plunger is advantageously configured to increase the rate at which fuel flows into the pumping chamber. In this way, the plunger may be configured to 'prime' the pumping chamber with pressurised fuel prior to the plunger pumping stroke. This leads to an increase in the pumping efficiency of the fuel pump due to the fact that the pumping chamber may be filled with a greater volume of fuel during the plunger-return stroke, which results in a subsequent increase in the pressure of the fuel that is output from the pumping chamber during the plunger-pumping stroke.

At high pumping frequencies the rapid movement of the plunger tends to reduce the time available to fill the pumping chamber with fuel during the plunger-return stroke. However, due to the increased flow of fuel into the pumping chamber, the fuel pump is able to operate at higher pumping frequencies (>150 Hz), whilst maintaining its pumping efficiency. In this way, the fuel pump is able to ensure consistent pumping throughout the pumping frequency range.

The invention is particularly advantageous when used in conjunction with a fuel system for supplying high-pressure fuel to an engine. When incorporated in such a system, a traditional fuel pump would typically be supplied with fuel from a relatively low pressure supply, and would be typically driven by, for example, an electric lift pump.

Advantageously, the pressurisation of fuel within the fluid-inlet path by the plunger significantly reduces the pressure at which fuel must be supplied to the fuel pump. This causes the pump to be less sensitive to the specifications of the inlet pipework. In other words, the fuel pump may be fitted with pipework that is rated to accommodate lower fuel pressures without compromising the operation of the pump.

When coupled to a fuel injection system for an engine, the higher pumping efficiencies enable the fuel pump to generate higher output pressures to the engine, particularly at higher engine frequencies, which enables higher engine speeds to be achieved, whilst simultaneously optimising the efficiency and combustion quality of the engine.

A portion of the fluid-inlet path may be defined by a priming-pump chamber. Advantageously, the priming-pump chamber may be configured to receive fuel, which may be pressurised by means of the plunger before being delivered to the pumping chamber.

The priming-pump chamber may be located remotely from the pumping chamber. In this way, the fuel within the priming-pump chamber may be conveniently isolated from the fuel in the pumping chamber. The fuel in the priming-pump chamber may therefore be pressurised independently from the fuel in the pumping chamber.

The pumping plunger may be associated with a priming-pump piston configured to cause pressurisation of the fuel in the priming-pump chamber. The piston may be advantageously attached to the shaft of the plunger and thereby configured to be received within the priming-pump chamber such that the movement of the plunger causes the priming-pump piston to move within the priming-pump chamber. Thus, the primary pump piston may be configured to cause a reduction in the effective volume of the fuel within the priming-pump chamber thereby causing the pressurisation of fuel in the fluid-inlet path.

The priming-pump piston may be an annular element connected to the pumping plunger. The annular priming-pump piston may be fixed to the circumferential surface of the plunger so that it may be received within the cylindrical priming-pump chamber. The priming-pump piston may be fixed in position by being received in an annular groove defined in the plunger, for example. The priming-pump piston may be a collet that can snap into such a groove and be thus fixed in position. Alternatively, the priming-pump piston may be welded in place, or press fit into position, particularly if the piston is a solid ring rather than a collet. The priming-pump piston may also be integral to the plunger. The annular configuration of the priming-pump piston may provide a uniform pressurisation of the fuel held within the cylindrical priming-pump chamber.

The fluid-inlet path may comprise a fluid-inlet passage leading from the priming-pump chamber to a pumping-chamber inlet. Advantageously, the fluid-inlet passage may provide a fluid connection from the priming-pump chamber to the pumping-chamber inlet in order to allow pressurised fuel from the priming-pump chamber to be delivered directly to the pumping-chamber inlet.

The fluid-inlet passage may be defined by the pump head. The fluid-inlet passage may be configured to permit fuel to flow into the priming-pump chamber from a fluid-inlet gallery. The fluid-inlet gallery provides a convenient junction for the interconnection of the fluid-inlet passage and the fluid-supply passage of the fluid-inlet path.

The fluid-inlet passage and the pumping-chamber inlet may be defined by the pumping plunger. This configuration advantageously removes the requirement for a pumping-chamber inlet to be provided in the pump head, thereby reducing the number of drillings that must be drilled in the pump heard. Incorporation of the fluid-inlet passage and the pumping-chamber inlet into the pumping plunger also provides greater design freedom when arranging the components of the fuel pump. The pumping-chamber outlet may be aligned with, for example, the pumping-chamber inlet, which is defined in the pumping plunger. This results in the pumping stresses in the pump head being substantially symmetrical about a central axis, defined by the pumping-chamber inlet, the pumping chamber outlet and the plunger barrel. This avoids any need for cross hole drillings within the pump head and also greatly reduces the inherent pumping stresses within the pumping chamber, as well as simplifying the machining of the fuel pump.

The pumping-chamber inlet may include the inlet valve. Advantageously, by incorporating the plunger-inlet valve into the pumping-chamber inlet of the plunger, the plunger-inlet valve response may be improved. The plunger-inlet valve may be configured such that the opening and closing of the valve may be assisted by the inertia of the movable valve members caused by the motion of the plunger. Thus, the plunger-inlet valve may be configured so that its movable parts have a lower mass than would be required to operate a valve that was located in the pump head. In this way, the operation of the plunger-inlet valve may benefit from the motion of the plunger.

The fluid-inlet path may further comprise a fluid-supply passage configured to supply fluid to the priming-pump chamber. The fluid-supply passage may supply fluid directly to the priming-pump chamber. In this way, the supply of fuel to the priming-inlet passage may be conveniently isolated from the supply of fuel from the priming-pump chamber to the pumping chamber.

The fluid-supply passage may supply fluid to the priming-pump chamber indirectly via the fluid-inlet passage. Advantageously, the fluid-inlet passage and fluid-supply passage of the fluid-inlet path may define the same passage. In this way, a single passage may be configured to supply fuel from the priming-pump chamber to the pumping chamber and from the inlet port of the pump head to the priming-pump chamber. Thus, the number of drillings required to supply fuel to and from the priming-pump chamber is reduced, thereby reducing the cost of manufacturing the fuel pump.

The fluid-supply passage may include valve means to prevent depressurisation of the priming-pump chamber therethrough. The valve means may be advantageously arranged to prevent the pressurised fuel in the priming-pump chamber from flowing through the fluid-supply passage during a pumping stroke of the priming-pump piston. During a return stroke of the priming-pump piston the valve means may allow fuel to flow through the fluid-supply passage in order to refill the priming-pump chamber.

The invention extends further to a fuel system comprising a fuel pump, the fuel pump comprising;

- a pump head defining a barrel in which a pumping plunger is slidable to pressurise fuel in a pumping chamber, and
- a fluid-inlet path through which fuel flows in to the pumping chamber under control of an inlet valve during a plunger return stroke, wherein the pumping plunger is configured to cause pressurisation of the fuel in the fluid-inlet path.

A fluid-outlet path may be provided through which fuel flows out of the pumping chamber, preferably under control of an outlet valve during a plunger pumping stroke, It will be appreciated that preferred and/or optional features of the first aspect of the invention may be incorporated alone or in appropriate combination within the second aspect of the invention also.

Figure 2C:
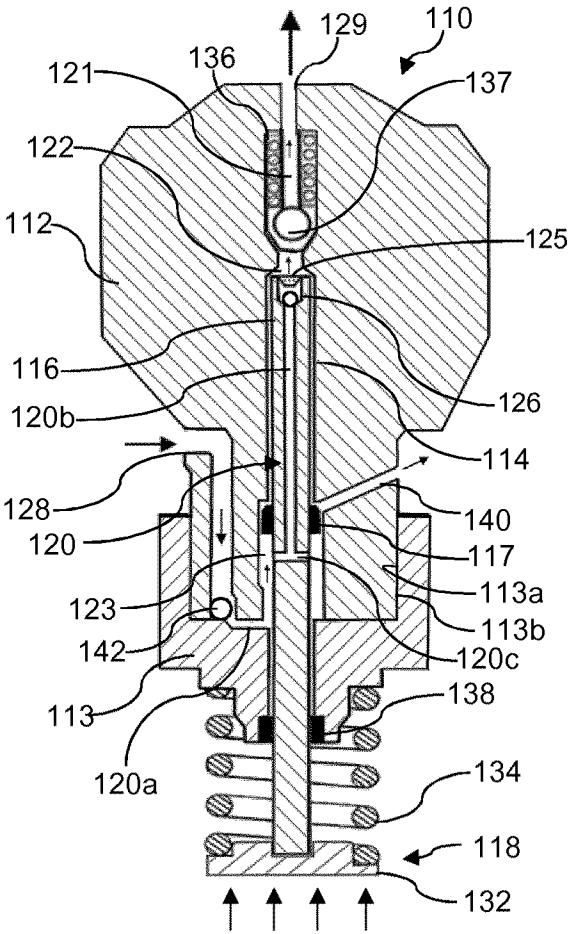
Figure 2B:
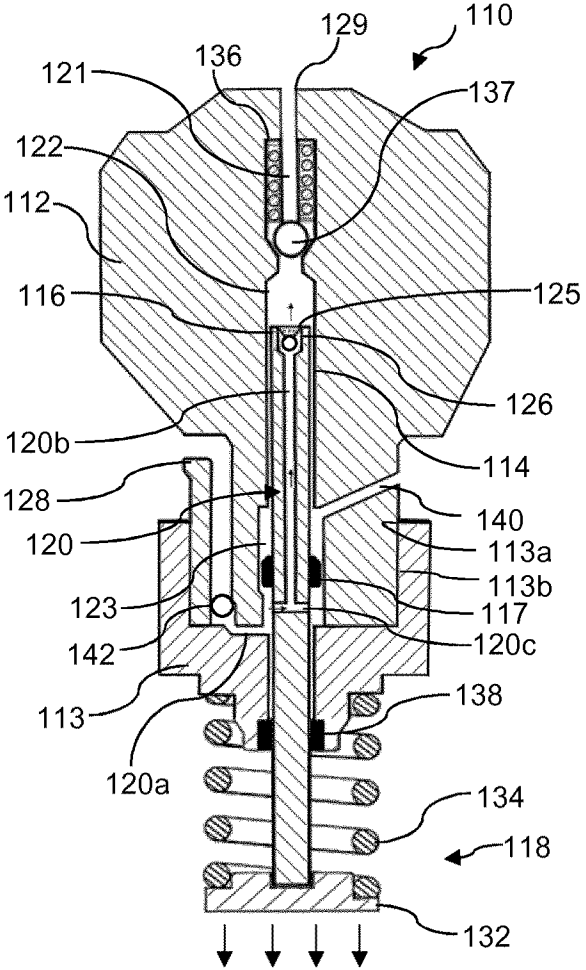
Figure 2A:
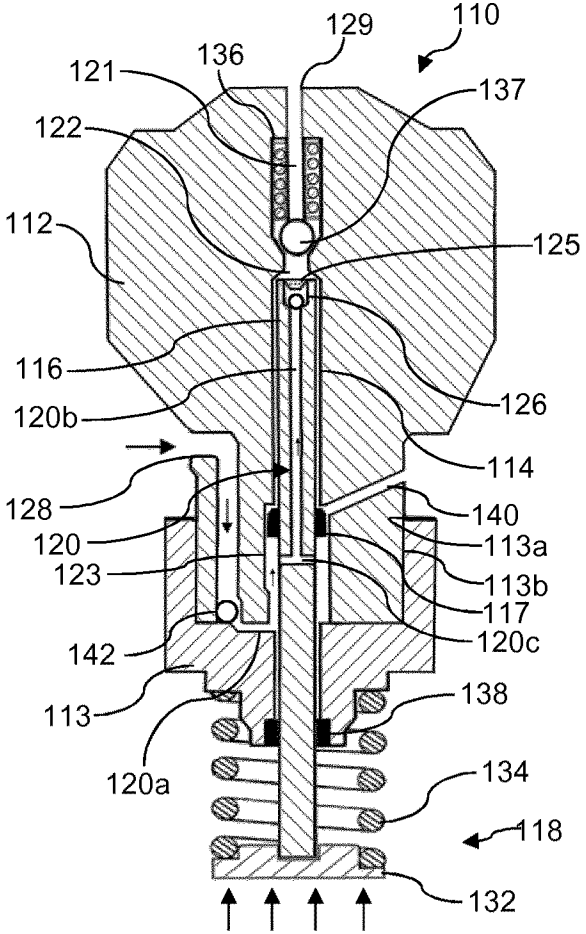
Figure 3C:
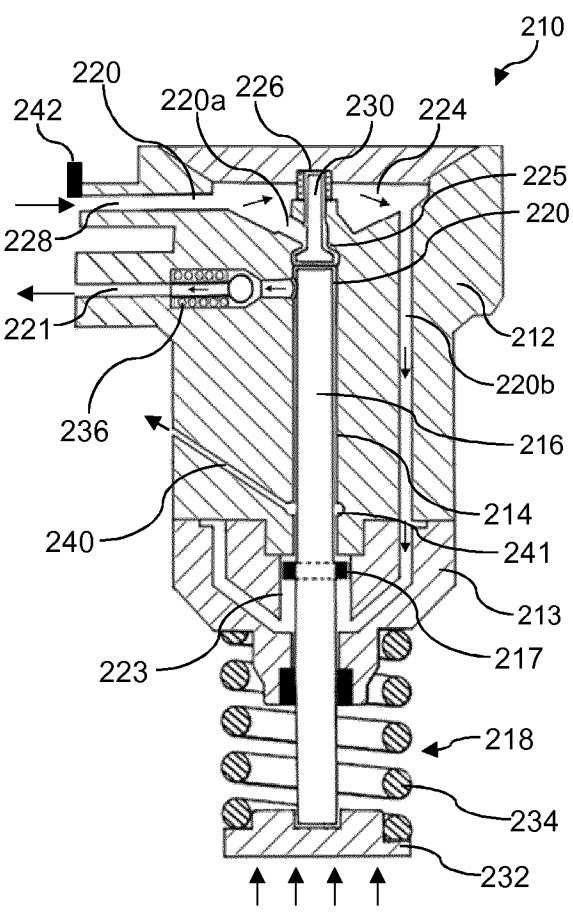
Figure 3B:
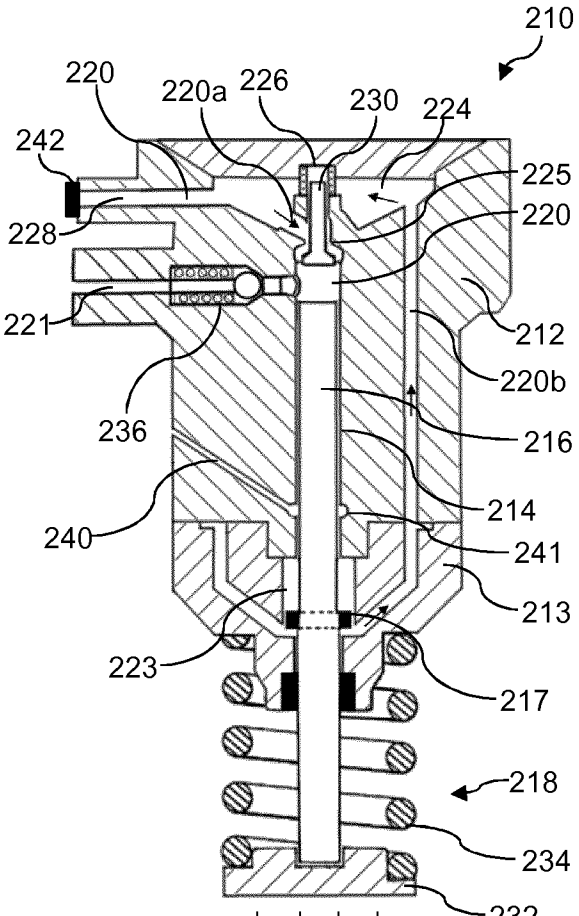
Figure 3A:
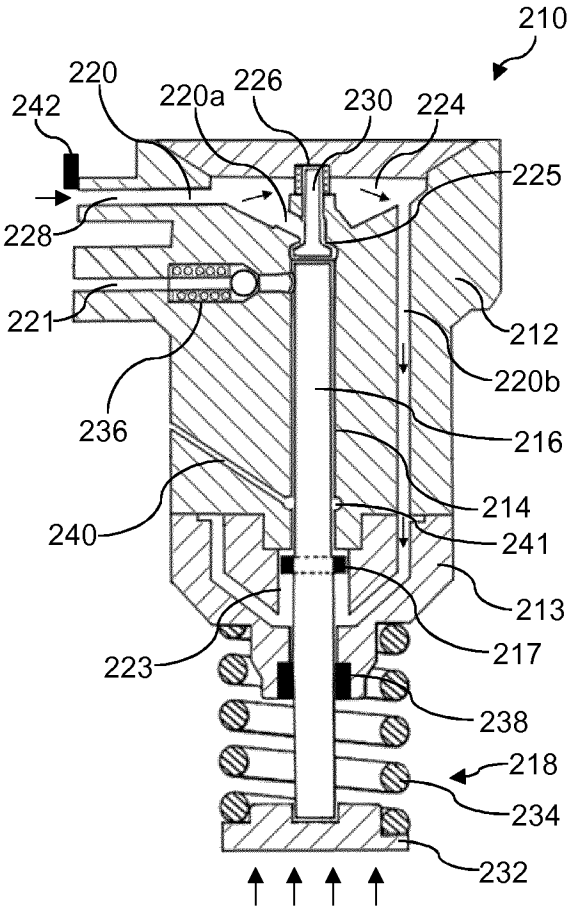

Preferred embodiments of the present invention will now be described, by way of example only, with reference to the accompanying drawings in which:

FIGS. 2*a*, 2*b* and 2*c* show a cross section of a fuel pump of a first embodiment of the present invention, where FIGS. 2*b* and 2*c* illustrate the return stroke and the pumping stroke of the fuel pump pumping cycle, respectively; and, FIGS. 3*a*, 3*b* and 3*c* show a cross section of a fuel pump of a second embodiment of the present invention, wherein FIGS. 3*b* and 3*c* illustrate the return stroke and the pumping stroke of the fuel pump pumping cycle, respectively.

DETAILED DESCRIPTION OF PREFERRED EMBODIMENTS

References in the following description to "upper", "lower" and other terms having an implied orientation, are not intended to be limiting and refer only to the orientation of the parts shown in the accompanying drawings. Also, although the embodiments relate to a fuel pump, references will also be made to 'fluid' which term is considered synonymous with fuel in the present context. However, it should be noted that the fuel pump of the embodiments described herein could also be used to pump fluids other than fuel.

Referring to FIG. 2*a*, a fuel pump 110 for use in a common rail fuel injector in a diesel engine of a vehicle includes a fuel pump head 112 provided with a plunger bore, or barrel 114, within which a pumping plunger 116 reciprocates, in use, under the influence of a drive arrangement 118. The plunger 116 and its barrel 114 extend co-axially through the pump head 112. An upper region of the plunger barrel 114 defines a pumping chamber 122 of the fuel pump 110. A fluid-inlet path 120, as will be described in further detail later, communicates with the pumping chamber 122 to supply fuel thereto. A fluid-outlet path 121 intersects a top region of the plunger barrel 114 and provides a path for fluid out of the pumping chamber 122.

The pumping chamber 122 communicates with the fluid-outlet path 121 and a downstream outlet port 129 of the pump head 112 via an outlet valve 136 which comprises a spring-biased ball-valve member 137 in this embodiment. The outlet port 129 is substantially co-axially aligned with the outlet valve 136, the fluid-outlet path 121 and the plunger 116. The outlet valve 136 controls the flow of fuel from the pumping chamber 122 to the fluid-outlet path 121 in dependence on the fuel pressure across the valve, as would be known to the skilled person. The pump head 112 is further provided with a sealing means, which is located at an opening where the plunger 116 exits the pump head 112. The sealing means, in the form of an annular rubber seal 138 is configured to prevent fluid and air from entering or exiting the plunger barrel 114.

The plunger 116 is reciprocally slidable within the plunger barrel 114 under the influence of a drive arrangement 118, which may be operated by a cam (not shown) to cause fuel pressurisation within the pumping chamber 122. The drive arrangement includes a tappet 132, which is coupled to the plunger 116 to impart drive thereto, in use, so that the plunger 116 performs a pumping cycle including a pumping stroke and a return stroke.

The tappet 132 is connected to a lower part of the pump housing 112 by a return spring 134. The return spring 134 is configured to impart a downward motion on the plunger 116 by recoiling once the force of the driving cam is removed. In so doing, the tappet 132 is pushed away from the pump head 112, thereby driving the plunger 116 outwardly from the plunger barrel 114.

Figure 1C:
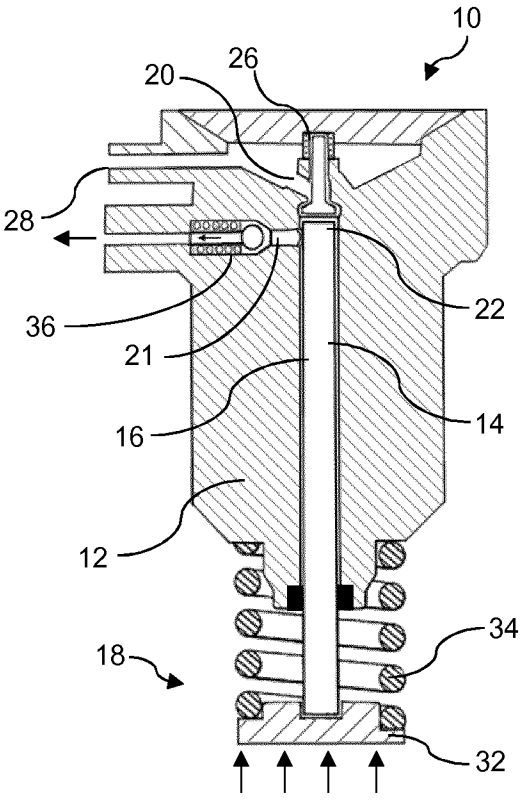
Figure 1c (prior art)
FIGS. 1*a*, 1*b* and 1*c*, which have already been described, show a cross section of a part of a known positive displacement fuel pump for a common rail fuel injection system at different stages of a pumping cycle.
Figure 1B:
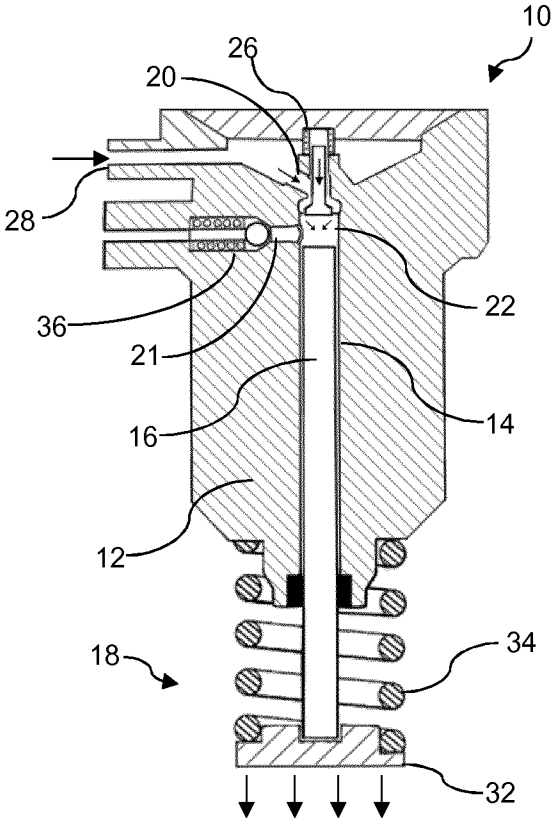
Figure 1b (prior art)
Figure 1A:
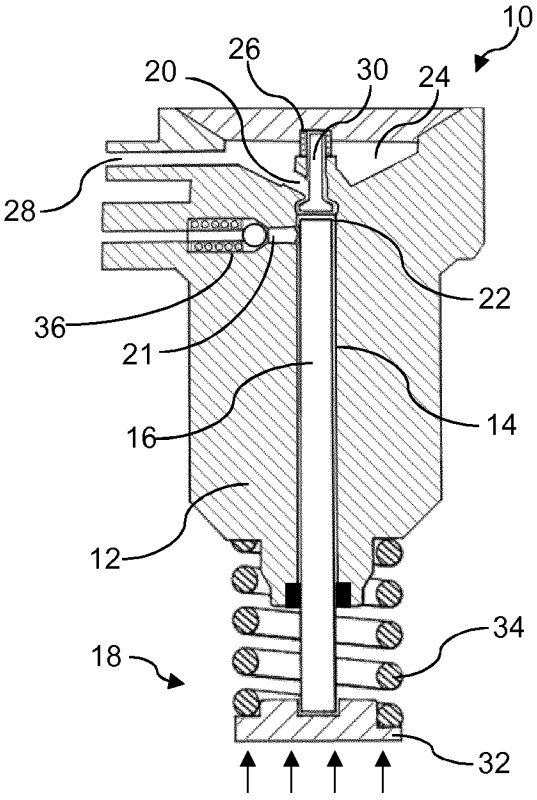
Figure 1a (prior art)

At this point it should be noted that, in contrast to the known fuel pump described above with reference to FIGS. 1*a* to 1*c*, the fuel pump of this embodiment includes an inlet 125 to the pumping chamber 122 that is not defined by the pump head 112 but instead is defined by the plunger 116 itself. Moreover, the inlet 125 defined in the pumping plunger 116 is fed by the fluid-inlet path 120 that is also defined at least in part, in the pumping plunger 116. One benefit of this is that it simplifies the design of the pump head 112 since only the fluid-outlet path 121 and associated outlet valve 136 needs to be accommodated by the pump head 112. So, there is freedom to locate the pump outlet port 129 in an optimal position or orientation, and fewer drillings in the pump head 112 are required which is a benefit in terms of manufacturing. Additionally, the plunger 116 is configured to cause pressurisation of the fuel in the fluid-inlet path 120, and this means that a smaller lift pump is required to pressurise fuel to supply the inlet side of the fuel pump 110. In general, the design that will now be described improves the pumping efficiency of the fuel pump 110 by providing substantially constant pressure at the pumping-chamber inlet 125 irrespective of pump speed.

Returning now to FIGS. 2*a* to 2*c*, it can be seen that a middle portion of the barrel 114 defines an enlarged diameter region that provides a priming-pump chamber 123 which is configured to receive low pressure fuel from an external supply line (not shown). The priming-pump chamber 123 is therefore located remotely from the pumping chamber 122. The supply line delivers low pressure fuel from a suitable source to an inlet port 128 of the pump head 112.

In the illustrated embodiment, the priming-pump chamber 123 is defined in part by an enlarged portion of the plunger barrel 114 which is located remotely from the pumping chamber 122. The priming-pump chamber 123 is closed at its bottom end by a priming-pump head 113. The priming-pump head 113 is adjacent the main pump head 112 and is positioned at an opening of the plunger barrel 114 where the plunger 116 exits the pump head 112. So, it will be appreciated that the priming-pump head 113 is a separate component in this embodiment that enables the convenient manufacture of the priming-pump chamber 123, although other configurations are possible. The priming-pump head 113 is shaped to define an annular wall 113*a* that provides a socket 113*b* which is received onto a complementary-shaped portion of the pump head 112. The priming-pump head 113 therefore mates with the pump head 112 to become an integral part of it. This mating of parts could be by way of a press fit or by way of a screw thread.

The fluid-inlet path 120 comprises a fluid-supply passage 120*a* configured to supply low pressure fuel from the inlet port 128 to the priming-pump chamber 123. In this way, the fluid-supply passage 120*a* supplies fluid directly to the priming-pump chamber 123.

The fluid-supply passage 120*a* includes a non-return valve 142 which is operable to control fuel supplied to the priming-pumping chamber 123 during the pumping stroke of the plunger 116. The non-return valve 142 prevents fuel from the priming-pump chamber 123 flowing back along the fluid-supply passage 120*a* and out of the pump head 112 via the inlet port 128, thereby preventing the depressurisation of the priming-pump chamber 123.

In order to pressurise fuel within the priming-pump chamber 123, the plunger 116 is associated with a priming-pump piston 117. In the illustrated embodiment, the priming-pump piston 117 is an annular element, such as a collet, that encircles a point along the length of the plunger 116. It is envisaged that various materials would be suitable for the priming-pump piston 117. For example, the piston 117 could be steel of the same or similar grade to the pumping plunger 116, or it could also be a suitable engineering plastic.

The priming-pump piston 117 is located at a fixed position along the plunger 116 such that, in use, the priming-pump piston 117 is positioned in the priming-pump chamber 123 and moves within it along with axial movement of the plunger 116. In this way the priming-pump piston 117 moves with the plunger 116 when it reciprocates in the barrel 114 to cause pressurisation of the fuel in the priming-pump chamber 123 during operation of the plunger 116. More specifically, the priming-pump piston 117 acts to draw fuel into the priming-pump chamber 123 when the plunger 116 moves upwardly in the barrel 114 when performing a pumping stroke, and acts to pressurise fuel in the priming-pump chamber 123 when the plunger 116 moves downwards.

The priming-pump piston 117 may be fixed in position by being received in an annular groove defined in the plunger 116, for example. If the piston is a collet, it would snap into such a groove and be thus fixed in position. Alternatively, it could be welded in place, or press fit into position, particularly if the piston is a solid ring rather than a collet. It could also be integral to the plunger. The skilled person would conceive of other techniques which could be used to combine the piston 117 and the plunger 116. In this way the priming-pump-piston 117 moves with the plunger 116 when it reciprocates in the barrel 114 to cause pressurisation of the fuel in the priming-pump chamber 123 during operation of the plunger 116. More specifically, the priming-pump piston 117 acts to draw fuel into the priming-pump chamber 123 when the plunger 116 moves upwardly in the barrel 114 when performing a pumping stroke, and acts to pressurise fuel in the priming-pump chamber 123 when the plunger 116 moves downwards.

In order to manage any fuel that makes it way past the outer surface of the priming-pump piston 117, a backleak channel 140 is provided in the form of a drilling in the pump head 112 that extends away from an upper end of the priming-pump chamber 123 at an oblique angle. Although not shown in the figures, the backleak passage 140 may be connected to a suitable source of relatively low pressure in order to draw away escaped fuel from the priming-pump chamber 123.

The pumping plunger 116 defines a series of passages or drillings that serve to convey pressurised fuel in the priming-pump chamber 123 to the main pumping chamber 122. As can be seen in the figures, the plunger 116 is provided with a longitudinal drilling 120*b* that allows fuel to flow through the plunger 116 from the priming-pump chamber 123 to the pumping-chamber inlet 125 located at the upper end of the plunger 116. The longitudinal drilling 120*b* communicates with the priming-pump chamber 123 via one or more cross drillings 120*c*. Due to this structure, the longitudinal drilling 120*b* can be considered to be a fluid-inlet passage 120*b* for the pumping chamber 122 and will be referred to as such from now on. The fluid-inlet passage 120*b* thus forms a part of the fluid-inlet path for the pumping chamber 122.

In this embodiment, the pumping-chamber inlet 125 includes a fluid-inlet valve 126 to control the flow of fuel into the pumping chamber 122 through the pumping-chamber inlet 125. The fluid-inlet valve 126 may be in the form of a spring-biased ball valve or may more simply be operable based on the pressure difference between the pumping-chamber inlet 125 and the pumping chamber 122. It is envisaged that the fluid-inlet valve 126 may be configured to permit fluid to enter the pumping chamber 122 at a pressure of approximately 8 bar which, it should be noted, is significantly higher than the working pressure of conventional lift pumps.

In summary, therefore, the pumping chamber 122 is connected through the pumping-chamber inlet 125 to the fluid-inlet path 120, under the control of the fluid-inlet valve 126, for receiving fuel at relatively low pressure from the priming-pump chamber 123. Thus, during operation the pumping chamber 122 receives partially-pressurised fuel from the priming-pump chamber 123, through the fluid-inlet path 120 and, more specifically, through the fluid-inlet passage 120*b* defined in the plunger 116, and delivers highly pressurised fuel through the fluid-outlet path 121.

Having described the general structure of the fuel pump 110, the following description explains the operation of the fuel pump 110 during pumping and return strokes. Here, references to 'pumping stroke' and 'return stroke' relate to the movement of the pumping plunger 116 within the barrel 114 and it should be noted that the priming-pump piston 117 performs pressurisation of the priming-pump chamber 123 (i.e. a piston-pumping stroke) during a return stroke of the pumping plunger 116, whereas the priming-pump piston 117 causes the priming-pump chamber 123 to be filled (i.e. a piston return or filling stroke) during a pumping stroke of the plunger.

FIG. 2*b* illustrates the plunger 116 during a return stroke in which it is driven outwardly in the plunger barrel 114 to increase the volume of the pumping chamber 122. At the beginning of the return stroke, the plunger 116 is at its innermost position within the barrel 114 and the priming-pump piston 117 is at an innermost position within the priming-pump chamber 123. In other words, when the plunger 116 is at the top of the plunger-pumping stroke the priming-pump piston 117 is at the bottom of the piston-pumping stroke.

As the plunger 116 moves outwardly with respect to the plunger barrel 114, the priming-pump piston 117 moves within the priming-pump chamber 123 in an outward direction, thereby reducing the volume of the priming-pump chamber 123 and causing pressurisation of the fuel therein, which then is forced into the fluid-inlet passage 120*b* of the plunger 116.

The pressurised fuel supplied to the fluid-inlet passage 120*b* results in an increase in the fuel pressure acting on the fluid-inlet valve 126 causing it to open against the spring force or, alternatively, against the pressure of the fuel in the pumping chamber 122 thereby allowing fuel to enter the pumping chamber 122 through the open fluid-inlet valve 126.

Turning to FIG. 2*c*, following a return stroke the plunger 116 performs a pumping stroke during which the plunger 116 is driven inwardly within the plunger barrel 114 to reduce the volume of the pumping chamber 122, thereby causing the pressurised fuel to be delivered through the outlet valve 136.

The pumping stroke starts when the plunger 116 is at its most outward position with respect to the plunger barrel 114. During the pumping stroke, the plunger 116 is driven inwardly within the plunger barrel 114 by the drive arrangement 118. The fuel pressure in the pump chamber 122 increases as the plunger 116 advances until, at a predetermined pressure level, a positive pressure differential is formed across the outlet valve 136 causing it to open. The pressurised fuel is then delivered through the outlet valve 136 to the outlet port 129 of the pump 110.

Advantageously, movement of the plunger 116 results in the delivery of partially-pressurised fuel from the priming-pump chamber 123 to the high pressure pumping chamber 122 which thereby ensures that a sufficient volume of fuel is delivered to the pumping chamber 122 before each pumping stroke of the plunger 116. Since the operation of the priming-pump chamber 123 and the main pumping chamber 122 are coupled by movement of the plunger 116, consistent delivery of fuel into the pumping chamber 122 is ensured throughout the engine speed range. Even at higher pumping frequencies, the pressurisation of fuel in the fluid-inlet path 120 is maintained thereby allowing the pumping chamber 122 to be sufficiently filled during every return stroke of the plunger 116. This improves volumetric efficiency of the fuel pump 110. It also makes the design of the fuel pump 110 less sensitive to the inlet pipework.

A particular advantage of configuring the fluid-inlet path 120 to pass through the plunger 116 is that it enables the high pressure fluid-outlet path 136 to be arranged in co-axial alignment with the plunger barrel 114. This avoids any need for cross hole drillings within the pump head 112 and also greatly reduces the inherent pumping stresses within the pumping chamber 122, as well as simplifying the machining of the fuel pump 110.

A fuel pump 210 in accordance with an alternative embodiment of the invention will now be described with reference to FIGS. 3*a* to 3*c*. The fuel pump 210 shares many similarities with the previous embodiment, most notably the functionality that fuel is pressurised in a priming-pump chamber 223 by movement of a plunger 216 so as to be delivered into a pumping chamber 222 under pressure. However, in this embodiment, as will now be discussed in detail, a fuel-inlet path 220 is defined through a pump head 212 of the fuel pump 210, rather than being in the plunger 216.

In the same way as the fuel pump 110 of the previous embodiment, the illustrated fuel pump 210 includes a fuel pump housing, or head 212, provided with a plunger barrel 214, or bore, within which a pumping plunger 216 reciprocates, in use, under the influence of a drive arrangement 218, which may be cam-operated. The plunger 216 and its barrel 214 extend co-axially through the pump head 212. An upper region of the plunger barrel 214 defines a cylindrical pumping chamber 222. Fuel is admitted into and is discharged from the pumping chamber 222 by a fluid-inlet path 220 and a fluid-outlet path 221, respectively.

The pump head 212 includes a backleak channel 240 that communicates with an annular scavenging groove 241 for managing fuel leakage between the barrel 214 and the plunger 216 in use.

A supply line 228 delivers low pressure fuel from a suitable source to a fluid-inlet gallery 224 via a supply passage 220*a*. The flow of low pressure fuel from the fluid-inlet gallery 224 to the pumping chamber 222 is controlled by an inlet valve 226. A spring-biased inlet valve member 230 of the inlet valve 226 is configured to control the rate of flow of fuel from the fluid-inlet gallery 224 to the pumping chamber 222. The inlet valve member 230 is displaced to an open or closed position in response to a change in the pressure differential between the fluid-inlet gallery 224 and the pumping chamber 222. An outlet valve 236 is provided to control the flow of pressurised fuel out of the pumping chamber 222 to the fluid-outlet path 221.

The pump cycle consists of a pumping stroke in which the plunger 216 is driven inwardly within the plunger barrel 214 by the drive arrangement 218 to reduce the volume of the pumping chamber 222 and a return stroke in which the plunger 216 is driven outwardly from the plunger barrel 214 to increase the volume of the pumping chamber 222. The operation of the drive arrangement 218 is the same as in previous embodiments and so will not be described again in detail here.

The fluid-inlet gallery 224 provides a reservoir for fuel before it is delivered to the pumping chamber 222 through the inlet valve 226. In a similar manner to the previous embodiment, the fuel pump 210 is configured with a priming-pump chamber 223 that increases the pressure of fuel in the gallery 224 in time for it to be drawn into the pumping chamber 222. The fuel pump 210 includes a fuel supply passage 220*b* in the pump head 212 that connects the gallery 224 and the priming-pump chamber 223, as will be described. Although the gallery 224 provides a convenient junction for the interconnection of the passages 220 and 220*b*, note that it is not essential.

The priming-pump chamber 223 is defined by an enlarged portion of the plunger barrel 214 which is located remotely from the pumping chamber 222. The priming-pump chamber 223 is contained within a portion of the fuel pump 212 that is defined by a priming-pump head 213. The priming-pump head 213 is adjacent the pump head 212 and is positioned at an opening of the plunger barrel 214 where the plunger 216 exits the pump head 212. So, it will be appreciated that the priming-pump head 213 is a separate component in this embodiment that enables the convenient manufacture of the priming-pump chamber 223, although other configurations are possible.

The plunger 216 is associated with a priming-pump piston 217, which is defined by an annular element, such as a collet, that is carried by the plunger 214. The piston 217 may be retained within an annular groove (not shown) on the plunger 216 or by other techniques that would be apparent to the skilled person. It may also be integral to the plunger although this may not be as convenient to manufacture. The priming-pump piston 217 is located at a position along the shaft of the plunger 216 such that, in use, the priming-pump piston 217 is located in the priming-pump chamber 223. In this way the priming-pump-piston 217 is configured to cause pressurisation of the fuel in the priming-pump chamber 223 during operation of the plunger 216.

The fuel supply passage 220*b* provides a fluid connection from the priming-pump chamber 223 to the gallery 224 and, thus, to the inlet valve 226 at a pumping-chamber inlet 225 of the pumping chamber 222. An upper portion of the fluid-inlet passage 220*b* is defined by the pumping head 212 and a lower portion of the fluid-inlet passage 220*b* is defined by the priming-pump head 213.

The fuel supply passage 220*b* therefore allows for a bi-directional flow of fuel, that is to say fuel flows along the passage 220*b* into the priming-pump chamber 223, thereby charging the priming-pump chamber 223 with fuel ready for pressurisation, and, conversely, partially pressurised fuel flows along the passage 220*b* from the priming-pump chamber 223 into the gallery 224 ready for delivery into the pumping chamber 222.

The fluid-supply passage 220*a* leading to the gallery 224 includes a fluid-supply valve 242 which is operable to control the quantity of fuel supplied to the priming-pumping chamber 223 during the pump stroke of the plunger 216. The fluid-supply valve 242 is configured to prevent fuel, from the priming-pump chamber 223, from flowing out of the gallery 224 and back along the fluid-supply passage 220*a* via the inlet port 228. In this way the fluid-supply valve 242 is configured to prevent the depressurisation of the fluid-inlet passage 220*b* and the priming-pump chamber 223 of the fluid-inlet path 220. The fluid-supply valve 242 may be configured to operate passively based on a pressure difference across it, or it may be electronically controlled.

During operation of the fuel pump 210, low pressure fuel flows through the pumping-chamber inlet 225, from the gallery 224, into the pumping chamber 222 under the control of the inlet valve 226. A spring-biased inlet valve member 230 of the inlet valve 226 controls the rate of flow of fuel from the gallery 224 to the pumping chamber 222. The inlet valve member 230 is displaced to an open or closed position in response to a change in the pressure differential between the fluid-inlet gallery 224 and the pumping chamber 222.

Thus, during operation of the fuel pump 210, the pumping chamber 222 is configured to receive semi-pressurised fuel from the priming-pump chamber 223, through the fluid-inlet path 220 (including the passage 220*b* and the gallery 224), and to deliver pressurised fuel to the common rail of the fuel injection system, through the fluid-outlet path 221.

The following description relates to the operation of the fuel pump 210 during pumping and return strokes of the pumping plunger 216.

The return stroke, as illustrated in FIG. 2*b* involves the plunger 216 being driven outwardly from the plunger barrel 214 to increase the volume of the pumping chamber 222. The outward movement of the plunger 214 also reduces the volume of the priming-pump chamber 223, thereby causing fuel from the priming-pump chamber 223 to flow through the fluid-inlet passage 220*b* and into the pumping chamber 222. In other words, the return stroke causes fuel to flow into the pumping chamber 222 through the fluid-inlet path 220 under the control of the inlet valve 226. Fuel is pressurised and driven out of the pumping chamber 222 through the fluid-outlet path 221 under the control of the outlet valve 236 during the pumping stroke.

At the beginning of the return stroke, the plunger 216 is at its innermost position within the barrel 214 and the priming-pump piston 217 is at its innermost position within the priming-pump chamber 223. As the plunger 216 moves outwardly with respect to the barrel 214, the priming-pump piston 217 moves within the priming-pump chamber 223 in an outward direction, forcing the fuel within the priming-pump chamber 223 into the fluid-inlet passage 220*b*. The fluid-supply valve 242 prevents fuel escaping from the inlet path 220 which causes the fuel to be pressurised. A quantity of semi-pressurised fuel from the priming-pump chamber 223 is supplied through the fluid-inlet passage 220*b* and the gallery 224 to the pumping chamber 222 via the fluid-inlet valve 226. In this way the plunger 216 is configured to cause pressurisation of the fuel in the fluid-inlet passage 220*b* of the fluid-inlet path 220. The fuel supplied through the fluid-inlet passage 220*b* results in fuel pressure acting on the fluid-inlet valve 226 causing it to open against the spring force. As fuel enters the pumping chamber 222 through the open fluid-inlet valve 226, the plunger 216 is pushed outwardly within the plunger barrel 214 with the tappet 232.

The pumping stroke is illustrated in FIG. 3*c*, and involves the plunger 216 being driven inwardly within the plunger barrel 214 to reduce the volume of the pumping chamber 222, thereby causing the pressurised fuel to be delivered through the outlet valve 236 to the fluid outlet path 221. During this movement of the plunger 216, the priming-pump piston 217 moves inwardly in the priming-pump chamber 223 which draws fuel into the priming-pump chamber 223 along the passage 220*b*. At this stage the fluid-supply valve 242 permits low pressure fuel into the inlet path 220 which replenishes the fuel supply therein, thereby allowing the priming pump chamber 223 to fill, ready for pressurisation Form the above discussion, it will be appreciated that the embodiment illustrated in FIGS. 3*a* to 3*c* provides similar benefits to the embodiment of FIGS. 2*a* to 2*c* in that the movement of the plunger 216 causes fuel to be pressurised within the priming pump chamber 223 for supply to the main pumping chamber 222. Therefore, the movement of the plunger is used to 'prime' the pumping chamber 222 with fuel rather than the conventional approach of using a high capacity pressurising fuel supply pump to charge the pumping chamber 222 with fuel. Beneficially, therefore, the embodiment of FIGS. 3*a* to 3*c* achieves the same pumping efficiency benefits as discussed in relation to FIGS. 2*a* to 2*c*.

It will be appreciated by a person skilled in the art that the invention could be modified to take many alternative forms without departing from the inventive concept, as defined by the scope of the appended claims.

The invention claimed is:

1. A fuel pump comprising;

a pump head defining a barrel in which a pumping plunger is slidable to pressurise fuel in a pumping chamber; and a fluid-inlet path through which fuel flows in to the pumping chamber under control of an inlet valve during a plunger return stroke;

wherein the pumping plunger is configured to cause pressurisation of the fuel in the fluid-inlet path;

wherein a portion of the fluid-inlet path is defined by a priming-pump chamber;

wherein the fluid-inlet path comprises a fluid-inlet passage leading from the priming-pump chamber to a pumping-chamber inlet; and wherein the fluid-inlet passage is defined by the pump head.

2. The fuel pump of claim 1, wherein the priming-pump chamber is located remotely from the pumping chamber.

3. The fuel pump of claim 1, wherein the pumping plunger is associated with a priming-pump piston configured to cause pressurisation of the fuel in the priming-pump chamber.

4. The fuel pump of claim 3, where the priming-pump piston is an annular element connected to the pumping plunger.

5. The fuel pump of claim 1, wherein the fluid-inlet passage is configured to permit fuel to flow into the priming-pump chamber from a fluid-inlet gallery.

6. The fuel pump of claim 1, wherein the fluid-inlet path further comprises a fluid-supply passage configured to supply fluid of the priming-pump chamber.

7. The fuel pump of claim 6, wherein the fluid-supply passage supplies fluid directly to the priming-pump chamber.

8. The fuel pump of claim 7, wherein the fluid-supply passage includes valve means to prevent depressurisation of the priming-pump chamber therethrough.

9. The fuel pump of claim 6, wherein the fluid-supply passage supplies fluid to the priming-pump chamber indirectly via the fluid-inlet passage.

10. The fuel pump of claim 9, wherein the fluid-supply passage includes valve means to prevent depressurisation of the priming-pump chamber therethrough.

11. A fuel system comprising the fuel pump of claim 1.

* * * * *